US005545508A

United States Patent [19]

Marchesano et al.

[11] Patent Number: 5,545,508

[45] Date of Patent: Aug. 13, 1996

[54] PHOTOGRAPHIC SILVER HALIDE DEVELOPER COMPOSITIONS AND PROCESS FOR FORMING PHOTOGRAPHIC SILVER IMAGES

[75] Inventors: Carlo Marchesano, Savona; Elda Moizo, Monesiglio; Filippo Faranda, Savona, all of Italy

[73] Assignee: Minnesota Mining and Manufacturing, St. Paul, Minn.

[21] Appl. No.: 605,248

[22] Filed: Feb. 13, 1996

Related U.S. Application Data

[63] Continuation of Ser. No. 253,413, Jun. 3, 1994, abandoned.

[30] Foreign Application Priority Data

Jul. 2, 1993 [EP] European Pat. Off. ..... 93110591

[51] Int. Cl.$^6$ ..... G03C 5/305

[52] U.S. Cl. ..... 430/265; 430/264; 430/268; 430/435; 430/436; 430/438; 430/439; 430/478; 430/482; 430/492

[58] Field of Search ..... 430/264, 265, 430/268, 435, 436, 438, 439, 478, 482, 492

[56] References Cited

U.S. PATENT DOCUMENTS 4,756,997 7/1988 Marchesano ..... 430/264

5,374,498 12/1994 Fujita et al. ..... 430/264

FOREIGN PATENT DOCUMENTS 0358165 3/1990 European Pat. Off. .

*Primary Examiner*—Hoa Van Le

*Attorney, Agent, or Firm*—Gary L. Griswold; Walter N. Kirn; Mark A. Litman

[57] ABSTRACT

A process for forming a black-and-white high contrast negative photographic silver image by development of a silver halide photographic element with an aqueous alkaline photographic developer composition comprising a dihydroxybenzene developing agent, an auxiliary superadditive developing agent, an antifogging agent, an antioxidant compound, a combination of buffering agents and a sequestering agent, characterized by the fact that: a) the auxiliary developing agent is an aminophenol compound, b) the combination of buffering agents comprises at least a first buffering agent represented by carbonate compounds and at least a second buffering agent represented by phosphate compounds, the total amount of said first buffering agent and said second buffering agent being at least 35 grams per liter, band c) the pH of said aqueous alkaline photographic developer composition is in the range 9.0 to 11.0.

20 Claims, No Drawings

PHOTOGRAPHIC SILVER HALIDE DEVELOPER COMPOSITIONS AND PROCESS FOR FORMING PHOTOGRAPHIC SILVER IMAGES

This is a continuation of application Ser. No. 08/253,413 filed Jun. 3,1994 now abandoned.

FIELD OF THE INVENTION

The present invention relates to photographic silver halide developer compositions and to a process for forming a black-and-white high contrast negative photographic silver image by development of a silver halide photographic element with an aqueous alkaline photographic developer composition.

BACKGROUND OF THE ART

In general, the processing of black-and-white silver halide photographic materials is performed in the order of development, stopping, fixing and washing.

Development is ordinarily carried out with aqueous alkaline developer compositions containing a developing agent, usually of the dihydroxybenzene type such as hydroquinone. The activity of these developing agents is greatly influenced by the pH of the solution and the optimum pH range should not significantly change during the useful life of the developer composition; therefore the composition possesses a high buffering capacity. The developer compositions are usually provided with antifogging agents (in particular inorganic antifogging agents such as soluble bromides and organic antifogging agents) to retard the development of non-exposed silver halide grains and decrease fog, i.e. silver formed as a result of the spurious development of said grains.

Antioxidant compounds are usually added to the alkaline developer composition to limit oxidation of the developing agents by air. Alkaline and ammonium sulfites are the most common compounds used for this purpose, but other antioxidant compounds such as hydroxylamine and ascorbic acid can be used instead of or in combination with such sulfites.

In graphic arts, there are two different conventional processing systems well known in the art. The "rapid access" and the "lith" processing system, able respectively to treat a "rapid access" film and a "lith" film. The "rapid access" processing system is characterised by the combination of a hydroquinone developer and an auxiliary developing agent, such as 3-pyrazolidone compounds or amino-phenol compounds, and high sulfite content. It has the advantage of wide processing latitude and excellent chemical stability, but the dot quality obtained is relatively poor. The "lith" processing system is characterised by a low free sulfite content and the application of hydroquinone as sole developing agent, as described by J. A. C. Yule in the *Journal of the Franklin Institute*, Vol. 239,221–230 (1945). It produces excellent dots and print results, but has very poor chemical stability and it needs long developing times.

Several alternatives to using a hydroquinone developing agent with a low sulfite content of the "lith" processing system to achieve high contrast development are known in the art. They are the so-called "high contrast" processing systems which use a hydrazine compound, either in the photographic element or in the developing solution, to promote high contrast, as described in U.S. Pat. No. 4,168,977. In U.S. Pat. No. 4,269,929, high contrast development of photographic elements is carried out in the presence of a hydrazine compound with an aqueous alkaline developing solution which has a pH of about 10 and below 12 (in the working examples the pH value is higher than 11) and contains a dihydroxybenzene developing agent, a 3-pyrazolidone developing agent, a sulfite preservative and a contrast-promoting amount of an amino compound. U.S. Pat. No. 4,172,728 describes a photographic developer containing hydroquinone, an auxiliary developer such as 1-phenyl-3-pyrazolidone, high sulfite content and an organic base such as diethanolamine; the developer is useful for processing lith film in rapid access machine processors to produce high contrast images. Additional patents on hydrazine compounds for high contrast images are U. S. Pat. Nos. 4,166,472; 4,221,857; 4,224,401; 4,237,214; 4,241,164; 4,272,606; 4,272,614; 4,311,781; 4,323,643; 4,332,878 and 4,337,634. However, relatively high pH levels in developing solutions containing hydrazide compounds, or in developing solutions used with photographic elements which contain hydrazine compounds, are needed in order to get the maximum improvement in contrast from the use of hydrazine compounds. The use of such high pH levels reduces the effective life of the developing solutions.

High contrast developing compositions which contain amino compounds and are intended for carrying out development in the presence of a hydrazine compound are also disclosed in U.S. Pat. Nos. 4,668,605 and 4,740,452. In fact, U.S. Pat. No. 4,668,605 describes developing compositions containing a dihydroxybenzene, a p-aminophenol, a sulfite, a contrast-promoting amount of an alkanolamine comprising a hydroxyalkyl group of 2 to 10 carbon atoms and a mercapto compound. The developing compositions of U.S. Pat. No. 4,740,452 contain a contrast-promoting amount of certain trialkyl amines, mono- alkyl-dialkanolamines or dialkylmonoalkanol amines. However, the need to use the contrast-promoting agent in a large amount and the volatility and odor-generating characteristics of amino compounds that are effective in enhancing contrast represent disadvantageous characteristics of the developer solutions therein described.

Recently, it has been found that well defined photographic elements can be developed in developing solutions having pH below 11.0. For example, U.S. Pat. No. 4,975,354 discloses photographic elements, particularly useful in the field of graphic arts, which are capable of high contrast development, when processed in the presence of a hydrazine compound that functions as a nucleating agent. The elements include certain amino compounds which function as incorporated boosters. The characteristics of the compounds contained in the photographic element allow the photographic element to be processed in a developer solution having a pH value in the range of 9 to 10.8.

European Patent application No. 446,078 describes a silver halide photographic material containing a novel compound for photomechanical processes as a contrast promoting agent. In the example, two developer solution compositions have been mixed to obtain a working solution having a pH value below 11. The first developer solution composition comprises a high molar ratio of buffering agent versus developing agent; the second developer solution composition comprises a 1-phenyl-3-pyrazolidone compound as auxiliary developing agent and a contrast promoting agent. Good dot quality and low pepper fog are claimed.

At present, in order to develop "rapid access" and "high contrast" films, two different types of chemical developing solutions must be used, with the disadvantage that the operator must change the developer solution each time he has to develop a film of the type different from the last one developed by the same developing apparatus. The only alternative is to use two different developing apparatus, the first one containing a "high contrast" processing system, and the second one containing a "rapid access" developing system.

It is desirable to have a stable developing solution, having a pH value below 11.0, able to develop both a "high contrast" film and a "rapid access" film, giving at the same time high contrasts by development of silver halide photographic elements.

SUMMARY OF THE INVENTION

A process is described for forming a black-and-white high contrast negative photographic silver image by development of a silver halide photographic element. The photographic element is developed with an aqueous alkaline photographic developer composition comprising a dihydroxybenzene developing agent, an auxiliary superadditive developing agent, an antifogging agent, an antioxidant compound, a combination of buffering agents and a sequestering agent, characterized by the fact that: a) the auxiliary developing agent is an aminophenol compound, b) the combination of buffering agents comprises at least a first buffering agent represented by carbonate compounds and at least a second buffering agent represented by phosphate compounds, the total amount of the first and second buffering agents being at least 35 grams per liter, and c) the pH of said aqueous alkaline photographic developer composition is in the range 9.0 to 11.0.

The developing composition having a pH value below 11.0 is stable and produces high contrast images by development of silver halide photographic elements.

DETAILED DESCRIPTION OF THE INVENTION

The dihydroxybenzene developing agents employed in the aqueous alkaline developing solutions of this invention are well-known and widely used in photographic processing. The preferred developing agent is hydroquinone. Other useful dihydroxybenzene developing agents include chlorohydroquinone, bromohydroquinone, isopropylhydroquinone, tolylhydroquinone, methylhydroquinone, 2,3-dichlorohydroquinone, 2,5-dimethylhydroquinone, 2,3dibromohydroquinone, 1,4-dihydroxy-2-acetophenone-2,5-dimethylhydroquinone, 2,5-diethylhydroquinone, 2,5-di-p-phenethylhydroquinone, 2,5-dibenzoylaminohydroquinone, 2,5-diacetamidohydroquinone, and the like.

Such developing agents are used in combination with aminophenol auxiliary developing agent or agents which show a superadditive developing effect, such as p-aminophenol and substituted p-aminophenols, e.g. N-methyl-p-amino-phenol (metol) and 2,4-diaminophenol. Other kinds of auxiliary developing agents, such as 3-pyrazolidone compounds, for example 1-phenyl-3-pyrazolidone (Phenidone) and 4-(hydroxymethyl)-4-methyl-1-phenyl-3-pyrazolidone (Dimezone S), are not useful in the present invention, because high contrast images cannot be obtained.

The aqueous alkaline developing compositions of this invention contain an antioxidant compound in a quantity sufficient to give good stability characteristics. Useful antioxidant compounds include the sulfite preservatives, i.e. any sulfur compound capable of forming sulfite ions in aqueous solutions, such as alkali metal or ammonium sulfites, bisulfites, metabisulfites, sulfurous acid and carbonyl-bisulfite adducts. Typical examples of sulfite preservatives include sodium sulfite, potassium sulfite, lithium sulfite, ammonium sulfite, sodium bisulfite, potassium metabisulfite, sodium metabisulfite, bisulfite-formaldehyde addition compound sodium salt, and the like. Also ascorbic acid is a known preservative against aerial oxidation of the developer for use in the developing composition of the present invention.

The antifoggant agents, known in the art to eliminate fog on the developed photographic silver halide films and useful in the developer compositions of this invention include, for example, organic antifoggant agents, such as derivatives of benzimidazole, benzotriazole, tetrazole, imidazole, indazole, thiazole, etc., used alone or in combination. The organic antifoggants are well known as discussed, for example, in Mees, *The Theory of the Photographic Process,* 3rd Edition, 1966, p. 344 –346 . Derivatives of benzotriazole are preferred in the practice of this invention, as described in EP Patent Application S.N. 182,293. Said derivatives include lower alkyl groups (having 1 to 4 carbon atoms), such as 5-methyl-benzotriazole, lower alkoxy groups (having 1 to 4 carbon atoms) or halogen (chlorine) substituted benzotriazole antifoggant agents.

At least an inorganic alkali agent is used in the developer compositions of this invention to achieve the preferred pH range which normally is above 10. The inorganic alkali agent group includes KOH, NaOH, potassium and sodium carbonate, etc.

Other developer adjuvants well known in the art may be used in the developer compositions of this invention. These include inorganic antifogging agents such as soluble halides (e.g. KBr and NaBr) and sequestering agents such as aminopolycarboxylic acid compounds, e.g. nitrilotriacetic acid (NTA), ethylenediaminotetracetic acid (EDTA), diethylenetriaminopentacetic acid (DTPA), diaminopropanoltetracetic acid (DPTA) and ethylendiamino-N,N,N',N'-tetrapropionic acid (EDTP), alpha-hydroxycarboxylic acid compounds (e.g. lactic acid), dicarboxylic acid compounds (e.g. oxalic acid and malonic acid), polyphosphate compounds (e.g. sodium hexamataphosphate) or diphosphonic acid compounds (e.g dialkylaminomethane diphosphonic acid as described in U.S. Pat. No. 4,873,180).

According to the present invention, said photographic silver halide developer composition contains a combination of buffering agents comprising at least a first buffering agent being represented by carbonate compounds and at least a second buffering agent represented by phosphate compounds, the total amount of the first and of the second buffering agent being at least 35 grams per liter. Preferably, the amount of carbonate compound is at least 10 grams per liter and, more preferably, at least 15 grams per liter. These particular amounts of buffering agents allow the developer solution to be stable against aerial oxidation and to obtain high contrast images.

Preferably in the process of the present invention, said photographic silver halide developer composition contains a stabilizing amount of a polyethylene glycol compound. Particularly, said polyethylene glycol compound corresponds to formula:

$$H—(—O—CH_2—CH_2—)—OH$$

wherein n is an integer from 2 to 25.

Polyethylene glycol compounds are viscous liquids or white solids which dissolve in water, forming transparent solutions. The higher the molecular weight, the lower is the solubility in water. These compounds, of low toxicity, are commercially available from a variety of commercial sources, for example Carbowax ™, registered trademark of Union Carbide Co., Polyglycol ™ E, trademark of Dow Chemical Co., Poly-G ™, trademark of Olin Mathieson Chemicals Co. and the like.

The black-and-white developer composition comprising the above reported polyethylene glycol compounds has a better resistance to air oxidation. The developer composition can be left in continuous transport automatic processors for several days, such as for instance for two days, without being replaced with fresh developer solutions or continuously replenished with a replenisher composition, and still maintains substantially an unchanged development capability. The effective stabilizing quantity of the polyethylene glycol ranges from about 30 to about 100 grams per liter, preferably from about 40 to about 70 grams per liter.

The aqueous alkaline developing compositions of this invention can vary widely with respect to the concentration of the various ingredients included therein. Typically, the dihydroxybenzene developing agent is used in an amount of from about 0.040 to about 0.70 moles per liter, preferably in an amount of from about 0.08 to about 0.40 moles per liter; the auxiliary developing agent is used in an amount of from about 0.0001 to about 0.15 moles per liter, preferably in an amount of from about 0.0005 to about 0.01 moles per liter; the inorganic antifogging agent is used in an amount of from about 0.001 to about 0.2 moles per liter, preferably in an amount of from about 0.01 to about 0.05 moles per liter; the antioxidant compound (such as the sulfite preservative)is used in an amount of from about 0,001 to about 1 moles per liter, preferably in an amount of from about 0.08 to about 0.7 moles per liter of solution; the organic antifogging compound is used in an amount of from about $1\times10^{-5}$ to about $5\times10^{-2}$ moles per liter, preferably in an amount,of from about $5\times10^{-4}$ to about $1\times10^{-2}$ moles per liter.

Of course, the stabilizing effect of the compounds of the present invention depends upon their chemical nature, upon the quantity with which they are used and upon the chemical nature of the developer composition the stability of which has been improved by adding the compounds of the present invention. The man skilled in the art can choose the most suitable compounds to be used and the quantities thereof according to his operational needs and the stabilization demands.

According to the present invention, it is deemed to be significant to evaluate the stability of the developing bath as absorbance variation (measured at 450 nm) when a sample of 100 ml developer solution is stored under room conditions in a 500 ml open "volumetric flask", a flat-bottomed flask with a long neck, in contact with air for significant times, for instance of one, two or three days (from a practical point of view two days and, still better, three days are a particularly significant time since they represent a week-end work stop).

Making reference to a two-day period of time, the stability of a developing bath can be said to be significantly improved according to the present invention when the absorbance, measured under the above specified conditions with a LAMBDA 5 spectrophotometer of Perkin Elmer, is brought to a value not higher than 0.400.

Of course, both the pH of the solution and the storing temperature will affect the obtained results. The higher the values of such variables, the higher in general the measured absorbance values.

Alternatively and preferably additionally, a bath can be considered to be stable when its pH is stable. In the present invention, a developing bath can be considered to be unstable when after two days under the above reported conditions its pH varies of an absolute value, which is the sum of all changes of at least 0.025, higher than 0.2 unit, while it can be considered to be stable when pH varies of an absolute value lower or equal to 0.2 units. The term "absolute value" obviously means that the total variation and the single variations it consists of are counted independently from their sign: a first variation from 0 to −0.2 and a further variation from −0.2 to +0.2, for instance, herein mean a total variation in absolute value of 0.6.

The developer composition of the present invention can be usually made as single concentrated liquid part that is then diluted with water in automatic processors by the use of a mixer, in order to have a ready-to-use solution. A method of making a concentrated alkaline photographic composition packaged in a single concentrated part to be diluted with water to form a ready-to-use solution is shown, for example, in U.S. Pat. No. 4,987,060. Normally, the concentrated developing solutions known in the art have specific dilution ratios for forming a ready-to-use solution having the required characteristics. The present invention shows the possibility of having a large latitude of dilutions; in fact, the concentrated formula can be used with different dilution ratios, while still keeping good sensitometric results and good stabilty against aerial oxidation.

In particular, the developer compositions of the present invention are useful in a process for forming high contrast silver images by development of a photographic element including a negative acting surface latent image-type silver halide emulsion layers in reactive association with a hydrazine compound and a contrast promoting agent.

The contrast promoting agent compound can be incorporated in the photographic element or in the developing solution or both in the developing solution and in the photographic element.

Preferred contrast promoting agents, which can be incorporated in the developing solution, include hydroxymethylidine group containing compounds, such as diarylmethanol compounds of formula (I):

$$R_1\ R_2CHOH \qquad (I)$$

wherein $R_1$ and $R_2$ each independently represent a hydrogen atom, an aliphatic group, an aromatic group, a heterocyclic group or $R_1$ and $R_2$ together complete a non aromatic cyclic group, as described in U.S. Pat. No. 4,693,956.

When the term "group" or "nucleus" is used in this invention to describe a chemical compound or substituent, the described chemical material includes the basic group or nucleus and that group or nucleus with conventional substitution. Where the term "moiety" is used to describe a chemical compound or substituent, only an unsubstituted chemical material is intended to be included. For example, "alkyl group" includes not only such alkyl moieties such as methyl, ethyl, octyl, stearyl, etc., but also such moieties bearing substituents groups such as halogen, cyano, hydroxyl, nitro, amine, carboxylate, etc. On the other hand, "alkyl moiety" or "alkyl" includes only methyl, ethyl, octyl, stearyl, cyclohexyl, etc.

Examples of Formula (I) include methyl alcohol, benzhydrol, 1,3-butanediol, 1,4-cyclohexanediol, phenylmethylcarbinol and the like.

Preferred contrast promoting agents, which can be incorporated in the photographic element, include diarylcarbinol compounds of formula (II) or (III):

$$R_1R_2R_3COH \qquad (II)$$

$$R_1R_2R_3C(CH_2)_mOH \qquad (III)$$

wherein $R_1$ and $R_2$ represent a substituted or unsubstituted aromatic group, $R_3$ represents a hydrogen atom, a substituted or unsubstituted alkyl group or a substituted or unsubstituted aromatic group and m represents a positive integer from 0 to 4 wherein $R_1$, $R_2$ and $R_3$ are bonded to the carbon atom in the formulae, as described in U.S. Pat. No. 4,777,118.

The diarylcarbinol compounds are incorporated into the photographic element prior to contact with the whole developer solution and preferably prior to the exposure of the photographic element itself, such as for example when the diarylcarbinol compound is introduced into the element prior to the coating of the emulsion layer. For example they can be incorporated in the silver halide emulsion layer of the element or in a hydrophilic colloidal layer of the element, particularly a hydrophilic colloidal layer adjacent to the emulsion layer in which the effects of the diarylcarbinol compounds are desired. They can, for instance, be present in the photographic element distributed between the emulsion and the hydrophilic colloidal layers, such as for instance a subbing layer, interlayers and protective layers.

The aromatic groups represented by $R_1$, $R_2$ and $R_3$ of formulas (I), (II) and (III) above include a naphthyl group and, preferably, a phenyl group. The alkyl groups represented by $R_3$ of formulas (II) and (III) above include branched or straight-chain alkyl groups, preferably low alkyl groups (having from 1 to 5 carbon atoms). Such groups may contain substituents, such substituents being chosen in nature and size as not to negatively affect their behaviour according to the present invention. For what concern their nature, such substituents include for example an alkyl group, an alkoxy group, a cyano group, a dialkylamino group, an alkoxycarbonyl group, a carboxy group, a nitro group, an alkylthio group, a hydroxy group, a sulfoxyl group, a carbamoyl group, a sulfamoyl group, a halogen atom, etc. For what concerns their size, such substituents are preferred to have from 1 to 10 carbon atoms, more preferably from 1 to 5 carbon atoms.

Parameters to take into proper account are solubility and boiling point of the diarylcarbinol compounds of the present invention. Said compounds are to be substantially soluble in water or soluble in water miscible solvents (by "substantially soluble" in water it is meant that they are to be soluble in water in a quantity of at least 1% by weight and by "soluble" in water-miscible solvents it is meant that they are to be soluble in water miscible solvents in a quantity of at least 5% by weight) in order to introduce them into the aqueous coating compositions used to form the layers of the photographic elements according to the present invention. Said diarylcarbinol compounds are required to have a sufficiently high boiling point not to evaporate during drying of the layer forming coating composition. Said boiling points are preferably higher than 150° C., more preferably higher than 200° C.

Specific examples of diarylcarbinol compounds for use in the process of this invention include the following:

1)diphenylmethanol (benzhydrol)

2)4,4'-dimethoxydiphenylmethanol 3)4,4'-dimethyldiphenylmethanol 4)2,2'-dibromodiphenylmethanol 5)4,4'-dibromodiphenylmethanol 6)2,2'-dinitrodiphenylmethanol 7)4,4'-dinitrodiphenylmethanol 8)2,3'-dimethoxydiphenylmethanol 9)2,4'-dihydroxydiphenylmethanol 10)4-methyldiphenylmethanol 11)4-ethyldiphenylmethanol 12)2,2',4,4'-tetramethyldiphenylmethanol.

The diarylcarbinol compounds are used to the purposes of the present invention incorporated into the photographic element in amount from about $10^{-4}$ to about $10^{-1}$ mole per mole of silver, more preferably in an amount from about $10^{-3}$ to about $5 \times 10^{-2}$ mole per mole of silver.

The addition of the contrast promoting agents directly to the emulsion may enable reduction of the concentration of contrast promoting agents in the developing solutions with attendant reductions in cost and environmental impact. The use of the unique class of diarylcarbinols and diarylmethanols can even eliminate the need for additional contrast promoting agents in the developer solutions. These carbinol classes of compounds can also reduce the dwell time necessary in developer baths and enable the film to perform well at lower pH levels than films without these contrast promoting agents present in the film prior to contact with the developer solutions. The addition of the contrast promoting agents directly to the film has not been found to adversely affect the sensitometry or characteristics of the film (e.g., graininess, sharpness, speed, Dmin, etc.).

Other contrast promoting agents useful for high contrast images are for example the alkanolamine compounds comprising a hydroxyalkyl group of 2 to 10 carbon atoms and a mercapto compound, as described in U.S. Pat. No. 4,668,605 or certain trialkyl amines, monoalkyl-dialkanolamines or dialkylmonoalkanol amines, as described in U.S. Pat. No. 4,740,452. Useful contrast promoting agents are also certain amino compounds which function as incorporated boosters described in U.S. Pat. No. 4,975,354. These amino compound contains within its structure a group comprised of at least three repeating ethyleneoxy units.

The silver halide emulsion layer includes negative acting surface latent image-type silver halide grains in reactive association with a hydrazine compound.

Preferably, the hydrazine compound is incorporated in the photographic element, for example in a silver halide emulsion layer or in a hydrophilic colloidal layer, preferably a hydrophilic colloidal layer adjacent to the emulsion layer in which the effects of the hydrazine compound are desired. It can, of course, be present in the photographic element distributed between the emulsion and the hydrophilic colloidal layers, such as a subbing layers, interlayers and protective layers.

Hydrazine compounds suitable to be incorporated into the photographic element are disclosed in GB Pat. Specification 598,108 and in U.S. Pat. No.2,419,974; they include the water soluble alkyl, aryl and heterocyclic hydrazine compounds, as well as the hydrazide, semicarbazide and aminobiuret compounds.

Other hydrazine compounds for incorporating in the photographic element are those represented by the formula:

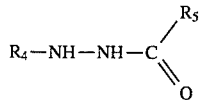

(IV)

wherein $R_5$ represents a hydrogen atom, an alkyl group having 1 to 3 carbon atoms, which may be a straight or branched-chain alkyl (e.g. methyl, ethyl, n-propyl and isopropyl) or a phenyl group. The phenyl group may be substituted with one or more substituents which preferably are electron attracting groups, such as halogen atoms (chlorine, bromine, etc.), a cyano group, a trifluoromethyl group, a carboxy group or a sulfo group, etc. $R_4$ represents a substituted or unsubstituted aromatic group. Examples of aromatic groups represented by $R_4$ include a phenyl group and a naphthyl group. Such aromatic groups may be substituted with one or more substituents which are not electron attracting, such as straight or branched-chain alkyl groups (e.g. methyl, ethyl, propyl, isopropyl, n-butyl, isobutyl, n-ottyl, n-hexyl, tert.-octyl, n-decyl, n-dodecyl, etc.), aralkyl groups (e.g. benzyl, phenethyl, etc.), alkoxy groups (e.g. methoxy, ethoxy, 2-methyl-propyloxy, etc.), amino groups which are mono- or disubstituted with alkyl groups, acylaminoaliphatic groups (e.g. acetylamino, benzoylamino, etc.), etc., as disclosed in U.S. Pat. No. 4,168,977 and in CA Pat. Specification 1,146,001. Such aromatic groups may also be substituted with a ureido group of formula:

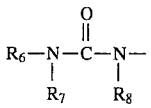

(V)

wherein $R_6$ and $R_7$ (which may be the same or different) each represents hydrogen, an aliphatic group (such as a straight or branched-chain alkyl group, a cycloalkyl group, a substituted cycloalkyl group, an alkenyl group and an alkynyl group), an aromatic group (such as a phenyl group and a naphthyl group) or a heterocyclic group; $R_8$ represents hydrogen or an aliphatic group (such as those listed above) as described in U.S. Pat. No. 4,323,643.

Specific examples of hydrazine compounds represented by the formula above are disclosed in U.S. Pat. No. 4,224,401.

Particularly preferred hydrazine compounds, for use according to this invention incorporated in the photographic element, are the formylhydrazine compounds corresponding to the formula:

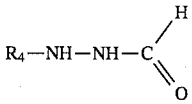

(VI)

wherein $R_4$ represents the same aromatic group of the formula (V) above.

Still other examples of hydrazine compounds, for use according to this invention incorporated in the photographic element, are those corresponding to the formula (IX):

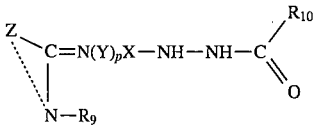

(VII)

wherein $R_9$ represents hydrogen, an aliphatic group which may be substituted; Y represents a divalent linking group; p represents 0 or 1; X represents a divalent aromatic group (such as for example a phenylene group, a naphthylene group and the analogous substituted groups thereof); $R_{10}$ represents a hydrogen atom, an aliphatic group which may be substituted and Z represents a non metallic atom groups necessary to form a 5- or a 6-membered heterocyclic ring. Specific examples of hydrazine compounds represented by the formula above are disclosed in U.S. Pat. No. 4,272,614.

In one particular preferred form, the hydrazine compound to be incorporated in the photographic element is substituted with ballasting groups, such as the ballasting groups of incorporated color couplers and other non-diffusing photographic emulsion addenda. Said ballasting groups contain at least 8 carbon atoms and can be selected from the relatively non reactive aliphatic and aromatic groups, such as alkyl, alkoxy, alkylphenyl, phenoxy, alkylphenoxy groups and the like.

Such hydrazine compounds can be incorporated in the photographic element using various methods well-known in the photographic art, the most common being the method of dissolving the hydrazine derivatives in a high boiling crystalloidal solvent and dispersing the mixture in the emulsion, as described for example in U.S. Pat. No. 2,322,027.

On the other hand, these developer compositions are useful, not only in a process for forming high contrast silver images by development of a photographic element including a negative acting surface latent image-type silver halide emulsion layers in reactive association with a hydrazine compound and a contrast promoting agent, but also in a process for forming silver images by development of a standard "rapid access" photographic element, such as those described in U.S. Pat. No. 4,659,647, not including hydrazine compounds.

The silver halide emulsions for use in the process of the present invention may be silver chloride, silver chlorobromide, silver iodo-bromide, silver iodo-chloro-bromide or any mixture thereof. Generally, the iodide content of the silver halide emulsions is less than about 10% iodide moles, said content being based on the total silver halide. The silver halide emulsions are usually monodispersed or narrow grain size distribution emulsions, as described for example in U.S. Pat. No. 4,166,742; 4,168,977; 4,224,401; 4,237,214; 4,241,164; 4,272,614 and 4,311,871. The silver halide emulsions may comprise a mixture of emulsions having different grain combinations, for example a combination of an emulsion having a mean grain size below 0.4 micrometers with an emulsion having a mean grain size above 0.7 micrometers, as described in Japanese Patent Application S.N. 57-58137 or a combination of two emulsions, both having a grain size below 0.4 micrometers, such as for example a first silver halide emulsion having a mean grain size of 0.1 to 0.4 micrometers and a second silver halide emulsion with particles having a mean grain volume lower than one half the particles of the first emulsion.

The silver halide grains of the emulsions for use in the process of the present invention are capable of forming a surface latent image, as opposed to those emulsions forming an internal latent image. Surface latent image-forming silver halide grains are most employed in negative type silver halide emulsions, while internal latent image-forming silver halide grains, though capable of forming a negative image when developed in an internal developer, are usually employed with surface developers to form direct-positive images. The distinction between surface latent image and internal latent image-forming silver halide grains is well-known in the art. Generally, some additional ingredients or steps are require in the preparation of silver halide grains capable of preferentially forming an internal latent image instead of a surface latent image.

In the silver halide emulsions for use in the process of the present invention, the precipitation or the growth of the silver halide grains may be carried out in the presence of metal salts or complex salts thereof, such as rhodium and iridium salts or complex salts thereof. According to the present invention, the presence of rhodium or iridium has been found anyhow not to be necessary to obtain the high contrasts. Silver halide grains free of rhodium or iridium, as well as those formed or ripened in the presence of rhodium and iridium may be used.

The silver halide emulsions of the process of the present invention may be not chemically sensitized, but are preferably chemically sensitized. As chemical sensitization methods for silver halide emulsions, the known sulfur sensitization employing sulfur compounds, the reduction sensitization employing mild reducing agents and the noble metal sensitization can be used, either alone or in combination.

The silver halide emulsions can be spectrally sensitized with dyes from a variety of classes, including the polymethine dye class, such as cyanines, merocyanines, complex cyanines and merocyanines (i.e., tri-, tetra- and poly-nuclear cyanines and merocyanines), oxonols, hemioxonols, styryls, merostyryls and streptocyanines.

The binder or protective colloid for the silver halide layer and layers of the photographic element is preferably gelatin, but other hydrophilic colloids or synthetic water insoluble polymers in the form of latexes can be used for partially or completely replacing gelatin.

In addition, the photographic elements may also contain any photographic additive known in the art, such as for example stabilizers, antifoggants, hardeners, plasticizers, development accelerators, gelatin extenders, matting agents and the like.

The following examples, which further illustrate the invention, report some experimental data which show the stability to aerial oxidation and the good sensitometric properties of the developer compositions of the present invention.

EXAMPLE 1

Silver halide photographic developer solution 1 was prepared according to the following Table 1.

TABLE 1

| | | |
|---|---|---|
| Water | ml | 800 |
| Sodium metabisulfite | g | 50 |
| KOH 35% | g | 166 |
| DTPA.5Na 40% | g | 4 |
| Hydroquinone | g | 19 |
| N-Methyl-p-aminophenol | g | 1 |
| 5-Methyl-Benzotriazole | g | 0.1 |
| KBr | g | 3 |
| KCl | g | 0.3 |
| Diethyleneglycol | g | 35 |
| $K_2CO_3$ | g | 10 |
| Water to make | l | 1 |
| pH at 20° C. | | 10.85 |

Developer solutions 2 to 17 were prepared as developer solution 1 modifying the amounts of the buffering agents as shown in table 2 .

TABLE 2

| Developer Solutions | $K_2CO_3$ g/l | $H_3PO_4$ 85% g/l |
|---|---|---|
| 1 (reference) | 10 | 0 |
| 2 (reference) | 20 | 0 |
| 3 (reference) | 30 | 0 |
| 4 (reference) | 40 | 0 |
| 5 (reference) | 0 | 10 |
| 6 (reference) | 0 | 20 |
| 7 (reference) | 0 | 30 |
| 8 (reference) | 0 | 40 |
| 9 (reference) | 10 | 10 |
| 10 (reference) | 10 | 20 |
| 11 (invention) | 10 | 30 |
| 12 (reference) | 15 | 10 |
| 13 (invention) | 15 | 20 |
| 14 (invention) | 15 | 30 |
| 15 (reference) | 20 | 10 |
| 16 (invention) | 20 | 20 |
| 17 (invention) | 20 | 30 |

A cubic silver chlorobromide emulsion $AgBr_{0.15}Cl_{0.85}$ of narrow grain size distribution and mean grain size of 0.23 micrometers was prepared by the conventional double jet procedure. The emulsion was then coagulated and washed in the conventional manner and reconstituted to give a final gelatin to silver ratio of 100 g gelatin/silver mole. A coating composition was prepared by mixing this emulsion with:

a wetting agent, 2-hydroxy-4,6-dichloro-1,3,5-triazine hardener (0.4 g/mole Ag), anhydrous 5,5'-dichloro-9-ethyl-3,3'-bis-(3-sulfopropyl) oxacarbocyanine hydroxide sodium salt green sensitizing dye (0.2 g/mole Ag) and 1-formyl-2-{4-[2-(2,4-di-t-penthylphenoxy)-butyramido] -phenyl}-hydrazine compound (1 g/mole Ag).

A coating was then prepared by the application of the described mixture onto a subbed polyester base at a silver coverage of 3.8 g/m$^2$ with the further addition of benzhydrol compound. (1 g/mole Ag). Strips were exposed in a sensitometer consisting of a 500 watt tungsten filament light source attenuated by a 0–4 continuous neutral image density wedge in contact with the film sample. Sensitometric tests were made at a temperature of 38° C. and development time of 60 seconds. Sensitometric results include Toe, Average and Shoulder contrast. The higher the contrast, the better is the dot quality of the image obtained. The Toe contrast corresponds to the absolute value of the slope of the line joining the density points of 0.07 and 0.17 above Dmin. The Average contrast corresponds to the absolute value of the slope of the line joining the density points of 0.10 and 2.50 above Dmin and the Shoulder contrast corresponds to the absolute value of the slope of the line joining the absolute density points of 1.60 and 4.00.

TABLE 3

| Developer Solutions | Toe Contrast | Average Contrast | Shoulder Contrast |
|---|---|---|---|
| 1 (reference) | 2.36 | 19.4 | 28.9 |
| 2 (reference) | 2.50 | 24.0 | 35.1 |
| 3 (reference) | 3.65 | 30.4 | 49.3 |
| 4 (reference) | 3.59 | 27.2 | 46.6 |
| 5 (reference) | 3.25 | 25.2 | 46.1 |
| 6 (reference) | 3.46 | 30.3 | 48.1 |
| 7 (reference) | 4.45 | 31.4 | 38.6 |
| 8 (reference) | 4.52 | 30.3 | 45.0 |
| 9 (reference) | 2.57 | 22.5 | 36.4 |
| 10 (reference) | 2.62 | 23.8 | 31.7 |
| 11 (invention) | 3.15 | 29.7 | 42.8 |
| 12 (reference) | 3.07 | 26.4 | 51.6 |
| 13 (invention) | 3.31 | 28.2 | 53.1 |
| 14 (invention) | 4.19 | 33.5 | 69.4 |
| 15 (reference) | 3.10 | 32.4 | 50.7 |
| 16 (invention) | 4.70 | 33.0 | 60.0 |
| 17 (invention) | 5.74 | 39.3 | 89.4 |

The preferred minimum acceptable values for Toe contrast, Average contrast and Shoulder contrast are, respectively, 3.0, 25 and 35. Therefore, Table 3 shows that the developer solutions 3–8 and 11–17 show good results in terms of contrast. The best results are obtained by developer solutions 14, 16 and 17.

The developer solutions showing good sensitometric results were checked through the following tests: samples of 100 mls of each developer were put into an open brown glass calibrated flask (capacity 500 ml) and the oxidation test through a continuous air contact was made in stressed conditions by the use of Dubnoff thermostatic bath 38° C. and constant agitation for 8 hours/day. At regular intervals, pH and absorbance at 450 nm were measured. The higher and faster the increasing of these characteristics, the lower the stability against air oxidation of the developing solution. A developer solution is considered useful against aerial oxidation when it shows good results both considering the pH test and the absorbance test.

The values of the pH and of the absorbance at 450 nm for the developer solutions stored for different hours are respectively reported hereinbelow in Table 4 and 5.

TABLE 4

| Developer Solutions | pH Values start | 8 h | 24 h | 32 h | 48 h |
|---|---|---|---|---|---|
| 3 (reference) | 10.81 | 11.10 | 11.59 | 11.97 | 12.25 |
| 4 (reference) | 10.80 | 11.02 | 11.41 | 11.84 | 12.06 |
| 5 (reference) | 10.85 | 11.00 | 11.50 | 11.87 | 12.07 |
| 6 (reference) | 10.85 | 11.04 | 11.37 | 11.50 | 11.75 |
| 7 (reference) | 10.85 | 10.98 | 11.25 | 11.35 | 11.57 |
| 8 (reference) | 10.85 | 10.95 | 11.17 | 11.24 | 11.47 |
| 11 (invention) | 10.85 | 10.92 | 11.15 | 11.39 | 11.45 |
| 12 (reference) | 10.85 | 11.05 | 11.37 | 11.82 | 11.90 |
| 13 (invention) | 10.85 | 11.01 | 11.23 | 11.60 | 11.68 |
| 14 (invention) | 10.85 | 11.01 | 11.21 | 11.52 | 11.60 |
| 15 (reference) | 10.80 | 11.06 | 11.32 | 11.81 | 11.90 |
| 16 (invention) | 10.80 | 10.88 | 11.09 | 11.16 | 11.36 |
| 17 (invention) | 10.85 | 10.85 | 11.05 | 11.12 | 11.31 |

TABLE 5

| Developer Solutions | Absorbance values start | 8 h | 24 h | 32 h | 48 h |
|---|---|---|---|---|---|
| 3 (reference) | 0.007 | 0.062 | 0.238 | 0.378 | 0.518 |
| 4 (reference) | 0.008 | 0.053 | 0.201 | 0.305 | 0.395 |
| 5 (reference) | 0.005 | 0.107 | 0.205 | 0.372 | 0.590 |
| 6 (reference) | 0.008 | 0.098 | 0.199 | 0.301 | 0.480 |
| 7 (reference) | 0.006 | 0.085 | 0.188 | 0.313 | 0.471 |
| 8 (reference) | 0.007 | 0.063 | 0.165 | 0.251 | 0.410 |
| 11 (invention) | 0.005 | 0.051 | 0.185 | 0.240 | 0.303 |
| 12 (reference) | 0.008 | 0.085 | 0.237 | 0.501 | 0.613 |
| 13 (invention) | 0.006 | 0.074 | 0.214 | 0.275 | 0.331 |
| 14 (invention) | 0.006 | 0.071 | 0.210 | 0.268 | 0.323 |
| 15 (reference) | 0.007 | 0.092 | 0.226 | 0.453 | 0.552 |
| 16 (invention) | 0.005 | 0.031 | 0.065 | 0.115 | 0.236 |
| 17 (invention) | 0.005 | 0.030 | 0.062 | 0.110 | 0.225 |

The acceptable pH values measured after 48 hours are those that do not exceed the value of 12.00. The acceptable absorbance values developer solutions useful in the present invention are those that show absorbance values less than 0.400, when measured at 450 nm after 48 hours. Tables 4 and 5 show that developer solutions 3 to 4, containing only carbonate compounds as buffering agent, and developer solutions 5 to 8, containing only phosphate compounds as buffering agent, are not useful in the present invention as regards to pH variation and/or absorbance variation during aerial oxidation test. In addition, also developer solutions 12 and 15, containing a total amount of buffering agents lower than 35 grams per liter, are not useful in the present invention as regards to pH variation and/or absorbance variation during aerial oxidation test. On the contrary, developer solutions 11, 13, 14, 16 and 17, containing a total amount of buffering agents of at least 35 grams per liter, are useful in the present invention, both for the sensitometric properties and for the stability versus pH and absorbance variation.

EXAMPLE 2

Silver halide photographic developer solutions 18 and 19 were prepared according to the following table 6. Each developer composition was obtained from developer solution 14 of Table 1, but each of them had different auxiliary developing agents. Developer composition 14 had a p-aminophenol compound, while developer solutions 18 and 19 had, respectively, 1-phenyl-3-pyrazolidone (Phenidone) and 4-(hydroxymethyl)-4-methyl-1-phenyl-3-pyrazolidone (Dimezone S) compounds as auxiliary developing agents.

TABLE 6

| | | 14 | 18 | 19 |
|---|---|---|---|---|
| Water | ml | 800 | 800 | 800 |
| Sodium metabisulfite | g | 50 | 50 | 50 |
| KOH 35% | g | 166 | 166 | 166 |
| DTPA.5Na 40% | g | 4 | 4 | 4 |
| Hydroquinone | g | 19 | 19 | 19 |
| N-Methyl-p-Aminophenol | g | 1 | — | — |
| Phenidone | g | — | 1 | — |
| Dimezone S | g | — | — | 1 |
| 5-Methyl-Benzotriazole | g | 0.1 | 0.1 | 0.1 |
| KBr | g | 3 | 3 | 3 |
| KCl | g | 0.3 | 0.3 | 0.3 |
| Diethylene Glycol | g | 35 | 35 | 35 |
| $K_2CO_3$ | g | 20 | 20 | 20 |
| $H_3PO_4$ 85% | g | 20 | 20 | 20 |
| Water to make | l | 1 | 1 | 1 |
| pH at 20° C. | | 10.85 | 10.85 | 10.85 |

The strips were exposed and processed as in Example 1. Table 7 reports the sensitometric results.

TABLE 7

| Developer Solutions | (Dev. time = 60 seconds) Toe Contrast | Average Contrast | Shoulder Contrast |
|---|---|---|---|
| 14 (invention) | 4.55 | 34.8 | 70.1 |
| 18 (reference) | 1.80 | 19.7 | 33.8 |
| 19 (reference) | 1.75 | 19.2 | 37.2 |

Table 7 shows that developer solutions 18 and 19 have contrast values too low to be acceptable. The only developer solutions useful in the present invention were those containing an aminophenol compound as auxiliary developing agent.

EXAMPLE 3

Strips of a 3M DRC (Daylight Rapid Contact) Film were exposed in a sensitometer as in Example 1 and developed through developer solution 14 of the present invention. The 3M DRC (Daylight Rapid Contact) Film comprised a silver chlorobromide emulsion $AgBr_{0.02}Cl_{0.98}$ of narrow grain size distribution and mean grain size of 0.20 micrometers prepared by the conventional double jet procedure and coated onto a subbed polyester base at a silver coverage of 2.5 g/m$^2$. Table 8 reports the sensitometric results compared to the same data obtained developing a sample of the same film through the 3M RDC V "rapid access" developing solution A having the following formula:

| | | |
|---|---|---|
| Deionized Water | g/l | 780 |
| Sodium metabisulfite | " | 18.04 |
| KOH 35% | " | 85 |
| DTPA.5Na 40% | " | 3.8 |
| Hydroquinone | " | 15 |
| Benzotriazole | " | 0.288 |
| 1-Phenyl-1H-Tetrazole-5-Thiol | " | 0.030 |
| KBr | " | 3.3 |
| Ethylene Glycol | " | 2 |

-continued

| | | |
|---|---|---|
| $KHCO_3$ 92% | " | 10 |
| Potassium Metabisulfite 96% | " | 20.48 |
| Diethanolamine | " | 8 |
| 1-Phenyl-3-Pyrazolidone | " | 0.380 |
| Water to make | l | 1 |
| pH at 20° C. | | 10.60 |

TABLE 8

| | (Dev.time = 60 seconds) | | | | | |
|---|---|---|---|---|---|---|
| Developer Solutions | Dmin | Dmax | Speed | Toe Contrast | Average Contrast | Shoulder Contrast |
| 14 invention | 0.03 | 6.07 | 0.82 | 0.86 | 6.11 | 7.44 |
| A reference | 0.03 | 6.05 | 0.77 | 1.25 | 6.99 | 8.13 |

The Example shows comparable results by developing the rapid access film with a dedicated rapid access developer and with the developer of the present invention.

EXAMPLE 4

Strips of a 3M EDG Argon Ion Film were exposed in a sensitometer as in Example 1 and developed through developer solution 14 of the present invention. The 3M EDG Argon Ion Film comprised a cubic monodispersed silver chlorobromide emulsion $AgBr_{0.40}Cl_{0.60}$ having a mean grain size of 0.15 micrometers prepared by the conventional double jet procedure. The resulting emulsion was gold and sulfur sensitized, coated onto a polyester base at a silver coverage of 2.5 g/m$^2$, exposed and developed as in Example 3. Table 9 reports the sensitometric results.

TABLE 9

| | (Dev.time = 60 seconds) | | | | | |
|---|---|---|---|---|---|---|
| Developer Solutions | Dmin | Dmax | Speed | Toe Contrast | Average Contrast | Shoulder Contrast |
| 14 invention | 0.04 | 5.15 | 0.55 | 1.18 | 5.60 | 8.64 |
| A reference | 0.04 | 5.28 | 0.59 | 1.17 | 5.70 | 11.10 |

Table 9 shows that the developing solution of the present invention is also useful to obtain good sensitometric data when it treats an other kind of "rapid access" film, different from the one developed in Example 3. In fact, the sensitometric data are comparable to those obtained by developing the same film with a standard "rapid access" processing system.

This fact, in addition to what described in the previous examples, shows that the developing solution of the present invention can be used as a stable developing solution for high contrast materials or as a developing solution for "rapid access" films.

We claim:

1. A process for forming a black-and-white high contrast negative photographic silver image comprising developing a silver halide photographic element, said developing being effected with an aqueous alkaline photographic developer composition comprising a dihydroxybenzene developing agent, an auxiliary superadditive developing agent, an antifogging agent, an antioxidant compound, a combination of buffering agents and a sequestering agent, characterized by the fact that:

a) the auxiliary developing agent is an aminophenol compound, b) the combination of buffering agents comprises at least a first buffering agent represented by carbonate compounds in an amount of 0.07 to 1 moles per liter and at least a second buffering agent represented by phosphate compounds present in an amount of from 0.07 to 1 moles per liter, the total amount of said first buffering agent and said second buffering agent being at least 35 grams per liter, and c) the pH of said aqueous alkaline photographic developer composition is in the range of 9.0 to 11.0.

2. A process for forming a high contrast photographic image of claim 1 wherein said first buffering agent is a carbonate compound in an amount of at least 10 g/l.

3. A process for forming a high contrast photographic image of claim 1 wherein said first buffering agent is a carbonate compound in an amount of at least 15 g/l.

4. A process for forming a high contrast photographic image of claim 1, wherein the dihydroxybenzene developing agent is hydroquinone.

5. A process for forming a high contrast photographic image of claim 1 wherein said aminophenol auxiliary superadditive developing agent is a p-aminophenol compound.

6. A process for forming a high contrast photographic image of claim 5 wherein said p-aminophenol auxiliary superadditive developing agent is a N-methyl-p-amino-phenol.

7. A process for forming a high contrast photographic image of claim 1 wherein said aqueous alkaline photographic developer composition contains a polyethylene glycol compound.

8. A process for forming a high contrast photographic image of claim 7 wherein said polyethylene glycol corresponds to the formula $$H-(-O-CH_2-CH_2-)_n-OH$$

wherein n is an integer from 2 to 25.

9. A process for forming a high contrast photographic image of claim 7 wherein the amount of polyethylene glycol compound is in the range from 20 to 100 grams per liter.

10. A process for forming a high contrast photographic image of claim 1, wherein the antifogging agents are selected within the group of the alkali metal halides.

11. A process for forming a high contrast photographic image of claim 1, wherein the antifogging agents are selected within the group consisting of benzotriazole compounds.

12. A process for forming a high contrast photographic image of claim 1, wherein the antioxidant compounds are selected within the group of alkali metal sulphites and ascorbic acid.

13. A process for forming a high contrast photographic image of claim 1, wherein the sequestering agent is selected within the group consisting of aminopolycarboxylic acid compounds, alpha-hydroxycarboxylic acid compounds, dicarboxylic acid compounds, polyphosphate compounds and dialkylaminomethane diphosphonic acid compounds.

14. A process for forming a high contrast photographic image of claim 1, wherein said silver halide photographic element has a negative acting surface latent image-type silver halide emulsion layer in reactive association with a hydrazine compound and a contrast promoting agent.

15. A process for forming a high contrast photographic image of claim 14, wherein the contrast promoting agent is included in the silver halide photographic element.

16. A process for forming a high contrast photographic image of claim 15, wherein the contrast promoting agent is a diarylcarbinol compound.

17. A process for forming a high contrast photographic image of claim 16, wherein the diarylcarbinol compound is represented by formula $$R_1R_2R_3COH \quad \text{(III)}$$

$$R_1R_2R_3C(CH_2)_mOH \quad \text{(II)}$$

wherein $R_1$ and $R_2$ represent an aromatic group, $R_3$ represents a hydrogen atom, an alkyl group or an aromatic group and m represents a positive integer from 0 to 4 wherein $R_1$, $R_2$ and $R_3$ are bonded to the carbon atom in the formulae.

18. A process for forming a high contrast photographic image of claim 14, wherein the contrast promoting agent is included in the aqueous alkaline photographic developer composition.

19. A process for forming a high contrast photographic image of claim 14 wherein the hydrazine compound corresponds to the formula:

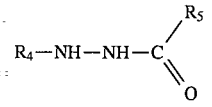

wherein $R_5$ represents a hydrogen atom, an alkyl group or an aryl group and $R_4$ represents an aromatic group.

20. A photographic silver halide developer composition comprising:

(a) a dihydroxybenzene developing agent in an amount of 0.04 to 0.7 moles per liter;

(b) an auxiliary developing agent in an amount of 0.0001 to 0.15 moles per liter;

(c) an inorganic antifogging agent in an amount of 0.001 to 0.2 moles per liter;

(d) an antioxidant compound in an amount of 0.001 to 1 moles per liter;

(e) a first buffering compound in an amount of 0.07 to 1 moles per liter;

(f) a second buffering compound in an amount of 0.07 to 1 moles per liter;

(g) a sequestering agent in an amount of $1\times10^{-4}$ to 0.2 moles per liter;

(h) an organic antifogging agent in an amount of $1\times10^{-5}$ to $5\times10^{-2}$ moles per liter;

(i) an inorganic alkali agent to have a pH in the range 9 to 13, and (j) water to make up one liter, characterized by the fact that:

a) the auxiliary developing agent is an aminophenol compound, b) the first buffering agent is represented by carbonate compounds and the second buffering agent is represented by phosphate compounds, the total amount of said first buffering agent and said second buffering agent being at least 35 grams per liter, and c) the pH of said aqueous alkaline photographic developer composition is in the range 9.0 to 11.0 .

* * * * *

UNITED STATES PATENT AND TRADEMARK OFFICE

CERTIFICATE OF CORRECTION

PATENT NO. : 5,545,508

DATED : August 13, 1996

INVENTOR(S) : Carlo Marchesano, Elda Moizo, Filippo Faranda

It is certified that error appears in the above-indentified patent and that said Letters Patent is hereby corrected as shown below:

In column 4, line 62, the formula is missing a letter "n".
It should read:

$$H \leftarrow O - CH_2 - CH_2 \rightarrow_n OH$$

Signed and Sealed this

Eighth Day of July, 1997

Bruce Lehman

*Attest:*

BRUCE LEHMAN

*Attesting Officer*

*Commissioner of Patents and Trademarks*